United States Patent [19]

Anderson

[11] 4,382,488

[45] May 10, 1983

[54] PUMP JACK POLES

[76] Inventor: Carl Anderson, 2581 Richmond Ter., Staten Island, N.Y. 10303

[21] Appl. No.: 143,506

[22] Filed: Apr. 24, 1980

[51] Int. Cl.[3] ..... E04G 1/20

[52] U.S. Cl. ..... 182/136; 182/145; 182/132; 182/178; 248/246

[58] Field of Search ..... 182/141, 133–136, 182/146, 178, 148, 46, 145; 248/246, 245, 354 L, 125, 297.5

[56] References Cited

U.S. PATENT DOCUMENTS

| | | | |
|---|---|---|---|
| 550,175 | 11/1895 | Holden | 182/178 |
| 1,714,044 | 5/1929 | Pedersen | 182/133 |
| 2,240,682 | 5/1941 | Weinstein | 182/136 |
| 2,765,136 | 10/1956 | Knapp | 248/246 |
| 3,650,081 | 3/1972 | McCracken | 182/179 |
| 4,136,785 | 1/1979 | McDevitt | 182/178 |
| 4,223,507 | 9/1980 | Mascaro | 182/219 |

FOREIGN PATENT DOCUMENTS

| | | | |
|---|---|---|---|
| 1940842 | 2/1970 | Fed. Rep. of Germany | 182/178 |
| 1197532 | 6/1959 | France | 248/246 |
| 422259 | 4/1967 | Switzerland | 248/246 |

*Primary Examiner*—Reinaldo P. Machado

[57] ABSTRACT

A pump jack upright pole formed of an elongated metal pole having a rubberized surface formed on only one side of the metal pole. The pump jack securely rides up and down the pole. The rubberized surface is longitudinally offset with respect to the pole so that it extends past one end of the pole while exposing the opposing end of the pole. A splint is arranged to be received within adjacent ends of poles being spliced together with the rubberized surface extending end overlying the exposed pole end of the next adjacent section. The rubberized sections are interfitted to provide a continuity so that the pump jacks can ride up and down the poles without interference.

21 Claims, 7 Drawing Figures

PUMP JACK POLES

BACKGROUND OF THE INVENTION

This invention relates to scaffolding equipment, and more particularly to upright poles for use with climbing pump jacks.

In working on exteriors of housing, and the like, it is customary to erect scaffolding to permit the workers access to the exterior surface and movement around the periphery of the house. The use of standard scaffolding is expensive and requires extensive amount of time to erect. Accordingly, it has become customary to utilize pump jacks which ride on upright poles and support a platform on which the workmen can stand.

The pump jacks are readily available, as for example, the pump jack sold by Hoitsma, Patterson, New Jersey. Such pump jacks contain shackles which clamp onto the upright pole and include a foot pump which is utilized for riding up of the pump jack on the upright. To descend, a release catch is provided which then permits the worker to crank down the pole by means of a hand crank. The pump jack integrally includes an extended arm on which can be placed a platform.

Typically, two pump jacks are utilized in conjunction with each other; each pump jack being installed on a respective upright pole. The upright poles are swung up and braced onto the exterior of the housing so as to be in a vertical position with the two uprights laterally spaced apart. Horizontal planks are then placed across the arms of the two pump jacks. The two pump jacks are then operated either by two separate workers substantially simultaneously, or by a single worker raising each side in sequence to thereby move the platform up and down the exterior of the housing.

The poles which are utilized for the uprights are formed by two 2 by 4s which are formed of wood. The two pieces of wood are fastened together by nails to form a single upright pole. The wood is generally carefully selected to be free of cross grain shakes, large loose or dead knots, or other defects which may impair strength and durability.

However, despite the care and selection of the wooden poles, there has been great difficulty in continued utilization of such poles and occasionally accidents have occurred by utilizing the well accepted wooden poles for such scaffolding.

One of the major problems of utilizing such wooden upright poles concerns the exterior surface of the poles. The pump jacks riding up and down the poles grip into the exterior surface of the poles. After continued use with the gripping and riding up and down of the poles, the poles become smooth and it becomes difficult to grip the poles. As a result, it is frequent that the pump jacks will no longer operate properly on the upright wooden poles and may actually slide down the poles. As a result, it is most important to continually change the poles every few months to be sure that sufficient gripping of the poles by the pump jack is obtained.

Additionally, despite the care in selecting and continuously replacing the poles, other deficiencies of the wooden poles continue to bring about accidents in utilizing such scaffolding equipment. For example, in swinging up the poles into a vertical position, the wooden material of the poles permit the poles to flex and oscillate. If the poles are swung up along the lateral surface of the poles, in many cases the pole will actually crack during the swing up. Such cracks may actually go unnoticed at the time of swingup and subsequently during use of the pump jack when the uprights are loaded, the crack may enlarge and the entire scaffold may collapse. In order to try and limit the possibility of the poles cracking, the poles are usually swung up along the butted surface of the 2 by 4s. However, even then the flexure of the wooden poles may still cause cracks to occur in the poles.

The use of the wooden poles also provides additional deficiencies as for example the shrinkage in size which occurs in wood after continuous use. Also, cracks can occur during the loading and unloading of the poles. The wooden material is also subject to damage by means of the weather conditions. Specifically, the wood may warp, it may bend during certain rain and moisture conditions, it may split due to expansion or contraction, and will provide for hidden latent defects which may go unnoted for some period of time until it causes an entire scaffold to collapse.

Because of the sway and flexure of the poles, it is generally necessary to provide additional bracing of the poles. Such bracing may include braces connected to the exterior surface of the house or the roof of the house, or may include interconnecting bracing between adjacent uprights. In either case, such extra bracing requires not only additional cost for the bracing, but requires time and effort to continuously connect and interconnect the bracing. This becomes especially a problem when the pump jacks must regularly ride up and down the poles and the bracing must be removed each time the pump jack approaches the brace.

Another problem with the use of the wooden poles concerns the splinting arrangement of lengths of poles. In order to provide a suitable length of approximately 30 or even 24 feet, the poles are interconnected in longitudinal sections. The poles are normally butt jointed with one section of 2 by 4 laterally spanning the butted ends of the adjacent 2 by 4s. When it is necessary to pick up an enlongated length of such pole, and if it is picked up from the center by means of a hoist, the weight from the two sides of the pole may cause the pole to crack.

Because of the aforementioned difficulties in utilizing the wooden poles, there have been many accidents, and even resulting deaths, due to the collapsing of some scaffold equipment. While attempts have been made to eliminate the wooden poles, thus far no acceptable substitute have been provided which would give adequate support for a platform and would permit secure riding of the pump jack up and down the poles.

SUMMARY OF THE INVENTION

Accordingly, it is an object of the present invention to provide a pump jack pole which avoids the aforementioned problems of prior art devices. Still another object of the present invention is to provide a pump jack pole which permits a pump jack to securely ride up and down the poles and which avoids the swaying, flexure, cracking, and other such problems heretofore encountered with the use of wooden poles.

A further object of the present invention is to provide a pump jack pole which will last considerably longer than prior art wooden poles. Still another object of the present invention is to provide a pump jack pole which is lightweight, easy to utilize, secure, long lasting, and will substantially eliminate the dangerous aspects of collapsing scaffolding equipment because of cracking uprights.

Another object of the present invention is to provide a pump jack pole which can be interconnected to other pump jack poles to extend the height of the scaffold.

A further object of the present invention is to provide a splinting arrangement for adjacent sections of pump jack poles.

A further object of the present invention is to provide a pump jack pole having opposing ends which can be matingly interconnected to respective opposing ends of other pump jack poles so as to extend the height of the poles to a desired length.

A further object of the present invention is to provide a pair of pump jack poles which are interconnected by bracing wherein the lateral spacing between the poles can be easily adjusted.

Briefly, in accordance with the present invention, there is provided a pump jack upright pole formed of a metal pole with a rubberized surface formed on one side of the metal pole for permitting a pump jack to securely ride up and down the pole.

In an embodiment of the invention, the metal pole is formed of aluminum tubing and has a rectangular cross sectional configuration. The rubberized surface is formed on only one side of the metal pole. The rubberized surface is typically a belting material having a fabric base material sandwiched between rubberized material on either side thereof. The rubberized belting is coupled to the aluminum pole by means of an adhesive as well as countersunk rivets.

Adjacent sections of the metal poles can be joined together by providing a splint tubing received within the abutting end sections and extending thereacross. The splint can be secured to the adjacent end sections by means of bolts passing through each of the end sections and through the splint received therein. Additionally, a pin can be placed transversely across the metal tubing as a safety support for the splint.

The rubberized material can be elongatedly offset with respect to the metal poles so that one end of the rubberized material extends a predetermined distance past the metal pole while exposing the opposing end of the metal pole a corresponding distance. The abutting ends of the poles can be arranged so that the rubberized material extending from one pole overlies the exposed portion of the next adjacent metal pole so that the abutting ends of the rubberized surfaces are longitudinally spaced from the abutting ends of the metal poles. The abutting ends of the rubberized surfaces can be matingly beveled as well as cut at an angle so as to provide an interlocking arrangement.

The aforementioned objects, features, and advantages of the invention will, in part, be pointed out with particularity, and will, in part, become obvious from the following more detailed description of the invention, taken in conjunction with the accompanying drawing which forms an integral part thereof.

BRIEF DESCRIPTION OF THE DRAWING

In the drawing.

In the various figures of the drawing, like reference characters designate like parts.

DESCRIPTION OF THE PREFERRED EMBODIMENT

Figure 1:
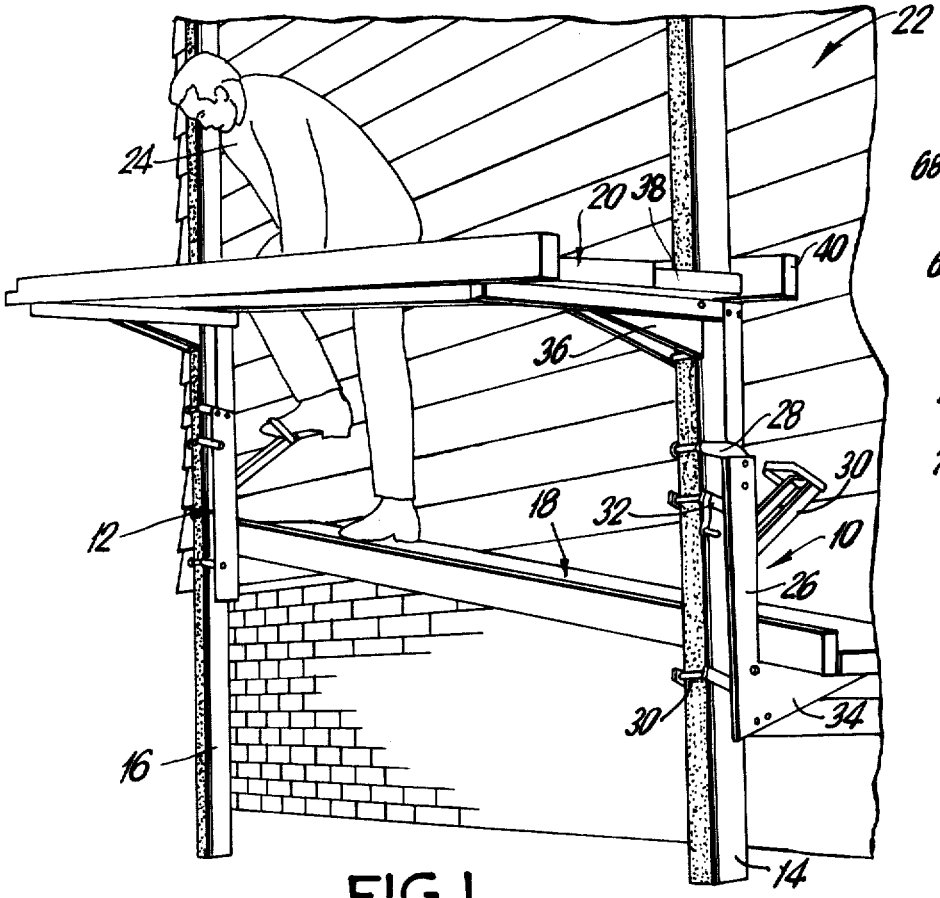
FIG. 1 is a perspective view of the pump jack pole of the present invention utilized as part of a scaffolding arrangement.

Referring now to FIG. 1, there is shown a pair of pump jacks, shown generally at 10 and 12, each respectively riding on an upright pole 14, 16 and supporting a lower platform 18, as well as an upper platform 20. The scaffolding is shown located adjacent to a building 22 on which a workman 24 is operating. Such scaffolding can be used for various types of exterior work such as placing of aluminum or vinyl siding, painting, exterior masonry or brick work, etc.

The pump jack typically includes a vertical section 26 supporting upper and lower shackles 28, 30 which are respectively operated by means of a foot pump 31 to cause the pump jack to ride up the poles 14, 16. To ride down the poles, a lock is released and the crank 32 is operated to lower the pump jack. The pump, as well as the shackles, will include gripping means to tightly hold onto the poles.

The vertical members 26 support a lower arm 34 on which is placed the platform 18. An upper arm 36 is provided which supports the upper platform. The platforms can typically be formed of planks of wood 38 with front and rear guard rails 40.

Heretofore, the uprights were formed by means of two 2 by 4s formed of wood which were coupled together to form a square upright pole. The shackles and crank of the pump jack would grip against the coupled joint of the wood. However, the use of such wood has been found to cause dangerous situations resulting from unnoted cracks, deterioration during use, flexure and swaying, as well as other problems. Such dangerous conditions have resulted frequently in many accidents.

Figure 2:
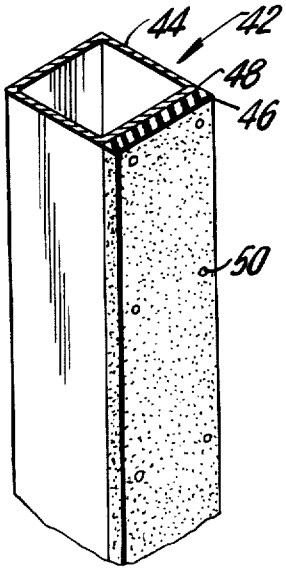
FIG. 2 is a perspective view of a section of the pump jack pole in accordance with the present invention.

The improved pole of the present invention is shown in more detail in FIG. 2. The pole is shown generally at 42 and comprises an elongated cylindrical metal tubing 44 on which is added a rubberized surface 46. The rubberized surface is attached to only one side of the metal tubing and is interconnected by means of an adhesive 48. Additionally, rivets 50 can be suitable spaced near the outer edges of rubberized surface in order to provide an additional level of security in the attachment between the rubberized surface and the metal tubing.

It should be noted, that the pump jack will ride up and down the metal pole and will grab into the rubber as it moves up and down. It would normally have been thought that in order to provide sufficient security for holding the pump jack tightly onto the pole, at least both opposing surfaces of the pole must have material in which the pump jack can bite into and grasp. When utilizing the prior art wooden poles, it is noted that the pump jack actually grabs onto both opposing sides of the wood as it rides up and down. It would therefore have been concluded that a similar arrangement is needed when utilizing any other types of poles. However, it has been found that the pump jack operates as well and even better than the wooden poles, when only a single side of the metal pole is coated with the rubberized surface. Of course, it is understood that both surfaces could be coated and the pump jack would still operate.

In trying to achieve the pole of the present invention, numerous other types of material were tried and tested. For example, initially a layer of wood was placed on the surfaces of the metal pole. After testing it was found that the wood wore off and would not function properly. Vinyl coating was also utilized on the outside of the metal pole but it was found to expand, crack, and did not provide sufficient grab. Other materials were similarly tested and none of them were found sufficient. However, the use of the rubberized surface was found to work most satisfactorily.

The pole of the present invention was constructed and tested and it was found to outlast the wooden poles by a considerable length of time. While the wooden poles must be replaced every few months, the poles of the present invention can be utilized for many years with sufficient safety.

Although the poles of the present invention can be made in lengths as desired, such as for example 24 feet in length, it is often necessary to splice together two pole sections in order to extend the length of the pole. When utilizing the prior art wooden poles, the poles being formed of two adjacent 2 by 4s it was possible to butt join the poles in making a splice and use nails to hold the adjacent pole sections together. Such arrangements are not suitable for the poles of the present invention. Accordingly, referring now to FIGS. 3 and 4, there will be shown an embodiment for splicing together adjacent pole sections.

Figure 3:
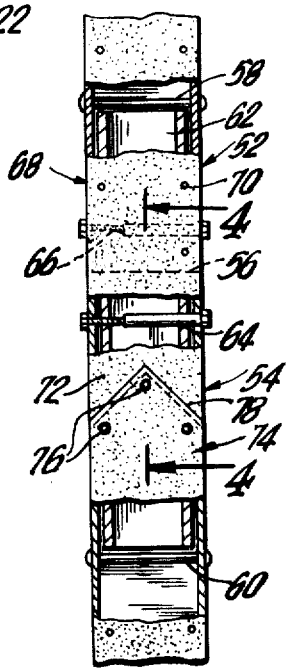
FIG. 3 is a partially broken away elevational view of the interconnected ends of adjacent pole sections.
Figure 4:
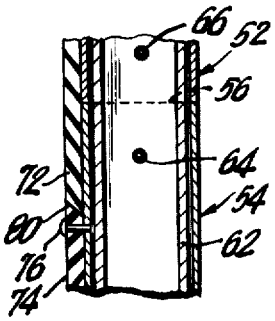
FIG. 4 is a sectional view taken along lines 4—4 of FIG. 3.

As shown in FIGS. 3 and 4, a first pole section 52 and a second pole section 54 are interconnected together at the joint line 56. Spaced adjacent each end of each pole section is placed a transverse pin 58, 60, which extends through the pole tubing. Such pins serve as a safety barrier, as will hereinafter be explained. Alternately, a metal plate or other barrier could be inserted.

A splint 62, also formed of metal tubing is inserted into the opposing ends of the adjacent pole sections and straddles across the joint line 56. The length of the splint 62 is such that it extends up to, but preferably does not touch the barrier pins 58, 60 contained in the adjacent pole sections. At the lower ends of both pole sections are formed openings which register within openings in the splint so that a bolt 64 can be placed through one set of registered holes and securely retain the splint in the pole section 54, and a similar bolt 66 can be inserted in the pole section 52 to securely retain the splint therein.

The bolts shown are of the type having a bolt threaded into a sleeve, however, other types of bolts or fastening means can be utilized as is well known in the art.

With the arrangement as shown, there is provided a double splint locking arrangement. The registered holes receiving the bolt 64, 66, provide the basic splint lock which securely retains the splint in the adjacent end of the pole sections. Additionally, the barriers 58, 60 provide a further safety feature so that should any of the bolts break, the splint will not slide through the whole tubing but will be held in place by means of the barrier pin. At the same time, by slightly spacing the splint from the barrier pins, it prevents the possibility of having the pins sheared when the poles are loaded.

Although the metal poles are joined along the joint line 56, the rubberized surfaces of the adjacent pole sections are joined at a location spaced from the joint line 56. The reason for this is to provide security of the pump jack riding up and down the poles and crossing over the joint lines so that a smooth transition would be had from one pole section to the other without having the pump jacks fail at the junction.

In order to provide for a suitable junction of the rubberized surface, the rubberized surface is longitudinally offset with respect to the metal poles. As a result, the rubberized surface will extend past one end of the metal pole by a predetermined distance and will expose the corresponding distance at the other end thereof. Accordingly, one end of the pole constitutes a male, and the other a female end. When joining two pole sections, a male and female end will be mated together.

Specifically, as shown in FIGS. 3 and 4, pole section 52 represents the male end and includes the rubberized surface 68 which is held onto the pole 52 both by an adhesive as well as by the rivets 70. The rubberized surface 68 extends past the end 56 of the pole 52 to provide the flap 72. The other pole section 52 similarly contains the rubberized surface 74 which is held in place by means of the rivets 76. However, this rubberized surface 74 represents the female end and terminates in spaced relationship from the end 56 of the pole 54.

When the two pole sections 52, 54, are joined, the flap 72 from the pole section 52 will overlie the exposed pole surface of the pole 54 and the edges of the flap 72 will interlock with the corresponding edge of the rubberized surface 74 along the joint line 78.

In order to provide a suitable joint at the rubberized surface, the joining edges are matingly beveled so that they will interfit with each other. Specifically, as can best be seen in FIGS. 3 and 4, the bevel line is shown as line 80 and shows that the bottom rubberized surface 74 constituting the female surface has its outer surface higher than the inner surface. On the other hand, the flap 72 has a mating beveled edge so that its inner surface is downward from its outer surface. In this manner, the bottom, female surface 74 will overlap the top flap 72.

In order to further provide for a suitble interfitting of the mating edges of the rubberized surfaces, the ends can be cut at a suitable angle. As shown, the joint edge 78 is shown in an inverted V-shaped cut. This will permit suitable interfitting of the two edges to provide a smooth joint thereacross. It is understood, however, that other types of angular cuts can be utilized, such as for example a diagonal cut completely crossing laterally the rubberized surface. Other interfitting mating joints can similarly be utilized.

The splint 62 is formed of a size so that it will tightly fit within the inside of the metal poles. However, when the rivets 70, 76 are present, the inside heads of the rivets may be spaced from the inner surface of the metal tubing and may accordingly provide an interference for the passage therethrough of the splint. Numerous methods of solving this problem are possible. For example, the heads of the rivets can be countersunk in order to provide a smooth inner surface of the metal tubing. Alternately, the splint can be of a size so that it will extend from the rivet heads to the opposing inner surface of the metal tubing. With the last type arrangement, a slight spacing will occur to accommodate the rivet heads. To take up the spacing an additional metal plate can be attached to the outer surface of the splint, which plate will laterally span the distance between the rivets.

Figure 7:
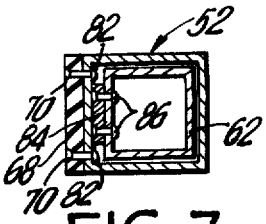
FIG. 7 is a cross sectional plan view of a pole with a splint contained therein in accordance with another embodiment of the present invention.

As shown in FIG. 7, the tube section 52 is shown with the rubberized surface 68 secured on one face thereof by means of the rivets 70 which are laterally spaced apart. The rivet heads 82 are shown to rest above the inner surface of the metal tubing and accordingly, the splint 62 would have to be of a size to reach up to the rivet heads 82. In order to take up the slack provided by the spacing between the heads 82 and the inner surface of the metal tubing, a metal plate 84 is riveted onto the splint 62 by means of the rivets 86. Rivets 86 can be countersunk at their outer edge to thereby prevent any further spacing problem. In this manner, a tight fit is provided between the splint and the metal tubing.

Figure 5:
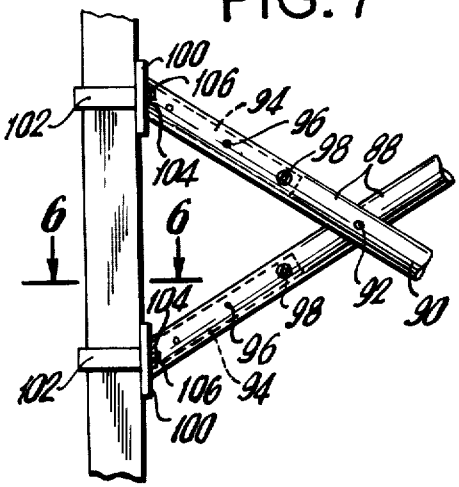
FIG. 5 is a fragmentary elevational view of the bracing interconnected to a pump jack pole.
Figure 6:
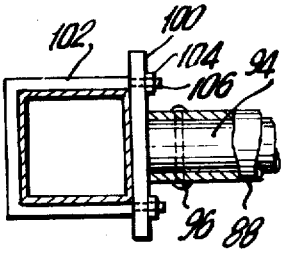
FIG. 6 is a sectional view taken along line 6—6 of FIG. 5.

Although generally it has been found that the poles of the present invention are sturdy enough not to require bracing, it may nevertheless be desired to include bracing as an extra safety precaution, or in order to conform with local regulations. One such bracing which can be utilized with the poles of the present invention is shown generally in FIGS. 5 and 6. The bracing includes the circular tubing 88, 90 pivotally interconnected at 92 to form an X configuration. Telescopically received within the ends of each tube is a pipe 94 which contains registered holes conforming with the plurality of openings 96. The pipes can be pulled out to the desired length so as to laterally space apart adjacent uprights to provide the desired lateral spacing therebetween. A suitable lock pin 98 is then inserted in the registered holes to lock the pipe within the tubing.

Connected at the end of the pipes is a plate 100 with a U-shaped brace 102 coupled to the plate and held in place by means of the nuts 104 which thread onto the threaded ends 106 of the U-shaped brace. In this manner, the U-shaped brace 102 can be locked into place thereby securing the tubing onto the poles. The brace can be positioned at the desired heights in order to conform with the lateral spacing whereby the X-shaped bracing can be utilized for various lateral spacings and heights of the poles.

Although one particular type of bracing has been shown, it should be understood that numerous types of bracing would be utilized in conjunction with the poles of the present invention in order to suitably clamp them in position and appropriately adjust the spacing therebetween.

By utilizing the poles of the present invention, numerous benefits are achieved. As was heretofore mentioned, the life of the poles are substantially longer than the prior art wooden poles and replacement of the poles are not needed as often. Furthermore, the sway and bending of the poles both during swingup as well as during loading and unloading are almost eliminated to thereby remove the possibility of cracks forming in the poles. The poles can also be lifted at their mid section without worrying about the weight of the poles on either side of the mid section cracking the poles. Also, the holes that are utilized for accommodating the bolts 64, 66, for attaching the splint to the poles can also be utilized for hoisting the poles by connecting a cable through these holes and grasping the steel poles to pull them upward. The poles of the present invention can also be utilized as the horizontal scaffolding. Specifically, three or four of the poles can be braced together and utilized in place of the horizontal sections 18 or 20 on the scaffold. The bracing together can be achieved by forming lateral holes passing through the three or four poles and passing a bolt entirely therethrough.

The rivets that are described for holding the rubberized surface in place can be countersunk into the rubber so that their heads will not protrude to interfere with the pump jack as it climbs up and down the poles. Such countersinking can be achieved by fraying the edges around the hole so that as the rivet enters it will sink into the rubber material. Other types of bolts could be utilized in place of the rivets as is well known in the art. Similarly, other types of fastening means could be utilized.

An example of the poles of the present invention were constructed with square aluminum tubing 3 inches by 3 inches in outside diameter with a wall thickness of $\frac{1}{8}$th inch. The pole height was 24 feet and the barrier pins were located 5 feet from each end of the pole. The rubberized material extended 1 foot past one end of the pole and correspondingly exposed one foot of the pole at the opposite end. The splint also comprised square aluminum tubing with an outside diameter of $2\frac{1}{2}$ inches and a wall thickness of $\frac{1}{8}$ inch.

The rubberized material consisted of rubberized belting material having a woven cotten base of approximately $\frac{1}{8}$th inch with a $\frac{1}{8}$ inch exterior neoprene rubber layer and an interior neoprene layer also of $\frac{1}{8}$ inch. The cotton base material can be two ply or three ply. The inner rubber layer can actually be eliminated and still achieve the same benefits.

An alternate type of rubberized material is the heavy duty "Nylon Supertex" conveyor belting material having a nylon, square woven carcass fabric with a thin layer of rubber between the carcass. A thick rubber is formed on one side of the carcass material and a thin rubber is formed on the opposite side. The thickness of the conveyor belting is $\frac{3}{8}$th inch or $\frac{1}{2}$ inch. Such belting is available from Baldwin Belting Inc., New York, N.Y. A similar type of belting is available under the registered mark "Plylon" sold by Goodyear Company. An antiozone factor has been added to prevent crazing of the belting.

Other types of rubberized material can be utilized as for example, any heat treated hard rubber with a canvas backing.

The contact cement that was used was any well known type suitable for such purpose. For example, one type of cement is available under the name "Con-Bond 985" sold by Columbia Cement Company, Inc. of Freeport, N.Y. It should be appreciated that the poles, although coming in prefixed lengths could actually be cut in situ and spliced together with other poles to provide for a desired length. Since one end of the pole already includes the male end, and the other includes the female end, and both ends already include the support pins, the pole can be cut at any length and one end thereof can be spliced to a mating end of another pole. The flat cut end would then be an end that would be placed on the ground or placed at the top of the pole. In this manner, any desired height of the pole could be achieved.

The mating of the rubber also increases the already strong tubing. The rubber acts as a shock absorber in every direction. Additionally, instead of having a flap extend from one end of the tubing, both ends could be exposed and a section of the rubberized surface could be spliced over the adjoining exposed ends of the tubing with suitable interfitting at both ends of the spliced section.

There has been disclosed heretofore the best embodiments of the invention presently contemplated. However, it is to be understood that various changes and modifications may be made thereto without departing from the spirit on the invention.

I claim:

1. A pump jack comprising an elongated metal tubing having a rectangular cross sectional configuration, and a rubberized surface formed on only one side of the tubing, said pole comprising two pole sections, a splint means for interconnecting said two sections at abutting ends thereof, said rubberized surface being longitudinally offset with respect to the pole sections so as to extend a predetermined distance past one end thereof and to expose a corresponding distance of the pole at the other end thereof, and wherein the interconnected ends have the extended rubberized surface of one pole section covering the exposed portion of the adjacent pole section such that the rubberized surfaces abut at a location spaced from the abutting ends of the pole sections.

2. A pump jack pole as claimed in claim 1, further comprising coupling means for connecting said rubberized surface to said one side of said pole.

3. A pump jack pole as in claim 2, wherein said rubberized surface comprises a rubberized belting material.

4. A pump jack pole as in claim 1, wherein said coupling material comprises an adhesive material between said rubberized surface and said metal pole.

5. A pump jack pole as in claim 2, wherein said coupling means further comprises a fastening means interconnecting said rubberized material and said metal pole.

6. A pump jack pole as in claim 1, wherein each of said pole sections comprise a transverse support pin spaced from the ends thereof, and wherein said splint comprises a metal tube straddling the interconnected pole sections and received within the end portions thereof, and extending between the adjacent support pins of the interconnected pole section.

7. A pump jack pole as in claim 6, and further comprising fastening means extending transversely through each pole section and the splint contained therein for locking the splint to the pole sections, and wherein said splint is slightly spaced from each of the adjacent support pins.

8. A pump jack pole as in claim 1, wherein the abutting sections of the rubberized surface are matingly beveled so that the edge of the rubberized surface of one pole section overlies the edge of the rubberized surface of the adjacent pole section.

9. A pump jack pole as in claim 1, wherein the abutting ends of the rubberized surface are matingly cut along an angle with respect to the elongated axis of the poles.

10. A pump jack pole as in claim 9, wherein said angled cut forms an inverted V-shape.

11. A pump jack pole as in claim 1, wherein said metal tubing is formed of aluminum material.

12. A pump jack pole as in claim 6, wherein said splint is formed of aluminum material.

13. A pump jack pole as in claim 2, wherein said rubberized belting material comprises a layer of fabric material sandwiched between rubber layers.

14. A pump jack pole as in claim 13, wherein said fabric material is formed of nylon.

15. In combination, a pump jack having upper and lower shackles, a foot pump for operating the shackles to cause the pump to climb up the pole, a crank for operating a roller permitting the pump jack to ride down the pole, and an extended arm on which a platform is positioned whereon workers, equipment and supplies are normally supported; and a pump jack pole comprising elongated metal tubing having a rectangular cross sectional configuration, a rubberized belting material, and means for securing said belting material onto one exterior side of said tubing facing between the shackles and toward said roller, said rubberized belting material being sufficient in strength to support the heavy weight carried by the pump jack as it climbs up and rises down the pole.

16. The combination as in claim 15, wherein said belting material has a fabric base and an outer rubberized layer.

17. The combination as in claim 15, wherein said securing material comprises an adhesive material.

18. The combination as in claim 15, wherein said securing material comprises fastening members spacedly positioned along said pole.

19. A pump jack pole comprising an elongated metal tubing having a rectangular cross sectional configuration, and a rubberized surface formed on only one side of the tubing, said pole comprising two pole sections, and splint means for interconnecting said two sections at abutting ends thereof, and further comprising laterally spaced apart rivet means coupling said rubberized surface to its respective pole section, and further comprising a metal plate at least a portion of which fits between the laterally spaced apart rivets and coupled to one side of said splint to thereby provide a tight fit of said splint within said pole sections.

20. A pair of upright poles, each of the type described in claim 19, and further comprising metal bracing for interconnecting said pair of upright poles in spaced relationship to each other, and clamping means for tightly securing said bracing to said poles.

21. A pump jack pole comprising an elongated metal tubing having a rectangular cross sectional configuration, and a rubberized surface formed on only one side of the tubing, said pole comprising two pole sections, and splint means for interconnecting said two sections at abutting ends thereof, and further comprising a splice of rubberized surface interconnecting the rubberized surfaces on each section, whereby the rubberized surfaces abut at a location spaced from the abutting ends of the pole sections.

* * * * *